US009759213B2

(12) United States Patent
Bassett et al.

(10) Patent No.: US 9,759,213 B2
(45) Date of Patent: Sep. 12, 2017

(54) COMPRESSOR VALVE HEALTH MONITOR

(71) Applicant: Computational Systems, Inc., Knoxville, TN (US)

(72) Inventors: Timothy Scott Bassett, Knoxville, TN (US); Matthew Carl Heller, Knoxville, TN (US); Terry Lynn Ford, Knoxville, TN (US)

(73) Assignee: Computational Systems, Inc., Knoxville, TN (US)

( * ) Notice: Subject to any disclaimer, the term of this patent is extended or adjusted under 35 U.S.C. 154(b) by 245 days.

(21) Appl. No.: 14/811,249

(22) Filed: Jul. 28, 2015

(65) Prior Publication Data

US 2017/0030349 A1 Feb. 2, 2017

(51) Int. Cl.

| | |
|---|---|
| ***F04B 39/10*** | (2006.01) |
| ***F04B 49/06*** | (2006.01) |
| ***F04B 27/04*** | (2006.01) |
| ***F04B 53/10*** | (2006.01) |
| ***F04B 51/00*** | (2006.01) |

(52) U.S. Cl.

CPC ..... *F04B 51/00* (2013.01); *F04B 27/0451* (2013.01); *F04B 39/10* (2013.01); *F04B 49/065* (2013.01); *F04B 53/10* (2013.01); *F04B 2203/0209* (2013.01); *F04B 2207/70* (2013.01)

(58) Field of Classification Search

CPC ..... F04B 51/00; F04B 53/10; F04B 27/0451; F04B 39/10; F04B 49/065; F04B 2203/0209; F04B 2207/70

USPC ..... 73/587

See application file for complete search history.

(56) References Cited

U.S. PATENT DOCUMENTS

| | | | |
|---|---|---|---|
| 5,895,857 | A | 4/1999 | Robinson et al. |
| 6,292,757 | B1 | 9/2001 | Flanagan et al. |
| 6,485,265 | B2 | 11/2002 | Schroeder et al. |
| 7,403,850 | B1 | 7/2008 | Boutin et al. |
| 8,366,402 | B2 | 2/2013 | St. Michel et al. |

(Continued)

OTHER PUBLICATIONS

Prognast Systems GMBH—Asset Performance Management for Reciprocating Compressors and Pumps—downloaded from www.prognast.com on Apr. 16, 2015—date of publication unknown.

(Continued)

*Primary Examiner* — J M Saint Surin

(74) *Attorney, Agent, or Firm* — Luedeka Neely Group, P.C.

(57) ABSTRACT

A rotating machine valve health monitor. Aspects of the valve monitor include instrumenting each valve of a reciprocating compressor, or other rotating machine, with a sensor capable of detecting at least vibration and instrumenting the crank shaft with a sensor capable of detecting at least rotation. A controller directly monitors the operation and condition of each valve to precisely identify any individual valve exhibiting leakage issues rather than only identifying the region of the leakage. The valve monitor uses a relatively high frequency stress wave analysis technique to provide a good signal-to-noise ratio to identify impact events indicative of leakage. The valve monitor uses circular waveforms of vibration data for individual valves to identify leakage by pattern recognition or visual identification. The valve monitor provides ongoing data collection to give warning of predicted valve failure and scheduling of preventative maintenance for failing valves.

20 Claims, 9 Drawing Sheets

(56) References Cited

U.S. PATENT DOCUMENTS

| | | | | |
|---|---|---|---|---|
| 8,807,959 | B2 | 8/2014 | Grant et al. | |
| 9,273,656 | B2 * | 3/2016 | Schule | F02D 35/023 |
| 9,279,715 | B2 * | 3/2016 | Hedin | G01H 1/003 |
| 2015/0233289 | A1 * | 8/2015 | Younkins | F02B 77/082 73/114.79 |
| 2016/0377506 | A1 * | 12/2016 | Bizub | G01H 1/006 702/35 |

OTHER PUBLICATIONS

Windrock, Inc.—C-Guard on Guard® module for comprehensive reciprocating compressor cylinder monitoring—Windrock, Inc.—Knoxville, TN USA—Jan. 4, 2011.

Windrock, Inc.—Windrock Online Monitoring Systems. Turning Data into Performance—Windrock, Inc.—Knoxville TN USA—downloaded from www.windrock.com on Apr. 21, 2015—date of publication unknown.

* cited by examiner

COMPRESSOR VALVE HEALTH MONITOR

CROSS-REFERENCE TO RELATED APPLICATIONS

Not Applicable.

BACKGROUND

Suction and discharge valves generally present the biggest maintenance concern on reciprocating compressors. Faulty valves substantially decrease compressor efficiency, among other problems. Conventional compressor monitoring systems rely heavily on analysis of pressure-volume (PV) curves to evaluate operation and determine status of suction and discharge valves in large reciprocating compressors. Such conventional compressor monitoring systems also monitor crosshead vibration or utilize portable ultrasonic sensors to evaluate valve health. While such configurations and techniques are useful locating an operational failure of a general region, such as an entire cylinder, they are unable to pinpoint the specific valves responsible for the problem. Replacing all valves in a region is costly, and downtime due to unplanned maintenance following a valve failure only adds to this cost.

More recently, a non-invasive velocity, acceleration, and temperature sensor designed to be mounted directly on a compressor valve cap and sense vibrations in the range of 2 Hz to 1500 Hz has been introduced. This low frequency range is not suitable for stress wave analysis and contains enormous normal vibration machinery and process operation and background noise information, all of which may be overwhelming compared to important signal information indicative of valve failure.

It is with respect to these and other considerations that the present invention was conceived.

BRIEF SUMMARY

The following summary discusses various aspects of the invention described more fully in the detailed description and claimed herein. It is not intended and should not be used to limit the claimed invention to only such aspects or to require the invention to include all such aspects.

Aspects of compressor valve health monitor, or valve monitor, include instrumenting each valve of a reciprocating compressor, or other rotating machine, with a sensor capable of detecting at least vibration and instrumenting the crank shaft with a sensor capable of detecting at least revolutions. Optionally, each valve is also outfitted with a sensor capable of collecting temperature data for that specific valve.

A controller directly monitors the operation and condition of each valve to precisely identify any valve exhibiting leakage issues rather than only identifying the region of the leakage. Data collection and analysis uses a relatively high frequency stress wave analysis technique to provide a good signal-to-noise ratio to identify impact events indicative of leakage. The high frequency stress wave analysis technique employs high pass or band pass filters to remove low frequency components below a selected cutoff frequency from the vibration signals. In various embodiments, the cutoff frequency ranges from about 5 kHz to about 20 kHz. In other words, a high frequency stress wave analysis technique is applied to data above about 5 kHz. This removes many of the normal low frequency vibration components typical in rotating machinery that tend to obscure the vibration signals corresponding to the flow turbulence at the valve.

Circular waveforms of vibration data for individual valves allow identification of leaking valves by pattern recognition or visual identification. Still further aspects include ongoing data collection (i.e., trending) allowing warning of predicted valve failure and scheduling of preventative maintenance for failing valves.

The use of waveform parameter bands allows enhanced notification and analysis. The valve monitor uses the waveform parameter bands to limit the amount of data that must be stored and analyzed in many cases. Further, the waveform parameter bands may be used to limit the portions of the waveform that trigger alarms and allow more precise alarm levels and the opportunity to customize alarm levels to a specific valve event.

By monitoring each valve independently, particularly with PeakVue or another high frequency stress wave analysis technology, the valve monitor is able to precisely determine which valve is having issues and request replacement of that particular valve rather than requesting replacement of all valves in a particular region. Continuous monitoring and trending of vibration data allows predictive analysis to identify valves exhibiting signs of impending failure and rapid reporting when a valve fails. By identifying failing valves prior to actual failure, the valve monitor allows valve replacement as part of a scheduled maintenance program, which reduces unplanned equipment downtime. By rapidly reporting a valve failure, the valve monitor allows plant operators to repair or replace leaking valves promptly, rather than allowing the equipment to operate at reduced efficiency due to the leaking valve. This also saves the equipment from the unnecessary and accelerated wear and tear that occurs when a valve fails and the equipment attempts to compensate. For example, the reciprocating compressor may work harder to maintain the expected pressure, placing stress on other components. Ultimately, detecting and/or predicting individual valve failure or degradation generate savings for the plant operators by decreasing repair or replacement costs, as well as repair downtime.

BRIEF DESCRIPTION OF THE DRAWINGS

Further features, aspects, and advantages of the present disclosure will become better understood by reference to the following figures, wherein elements are not to scale so as to more clearly show the details and wherein like reference numbers indicate like elements throughout the several views.

DETAILED DESCRIPTION

A rotating machine valve health monitor, or valve monitor, is described herein and illustrated in the accompanying figures. Aspects of the valve monitor include instrumenting each valve of a reciprocating compressor, or other rotating machine, with a sensor capable of detecting at least vibration and instrumenting the crank shaft with a sensor capable of detecting at least rotation. A controller directly monitors the operation and condition of each valve to precisely identify any individual valve exhibiting leakage issues rather than only identifying the region of the leakage. The valve monitor uses a relatively high frequency stress wave analysis technique to provide a good signal-to-noise ratio to identify impact events indicative of leakage. The valve monitor uses circular waveforms of vibration data for individual valves to allow identification of leaking valves by pattern recognition or visual identification. The valve monitor provides ongoing data collection to give warning of predicted valve failure and scheduling of preventative maintenance for failing valves.

Figure 1:
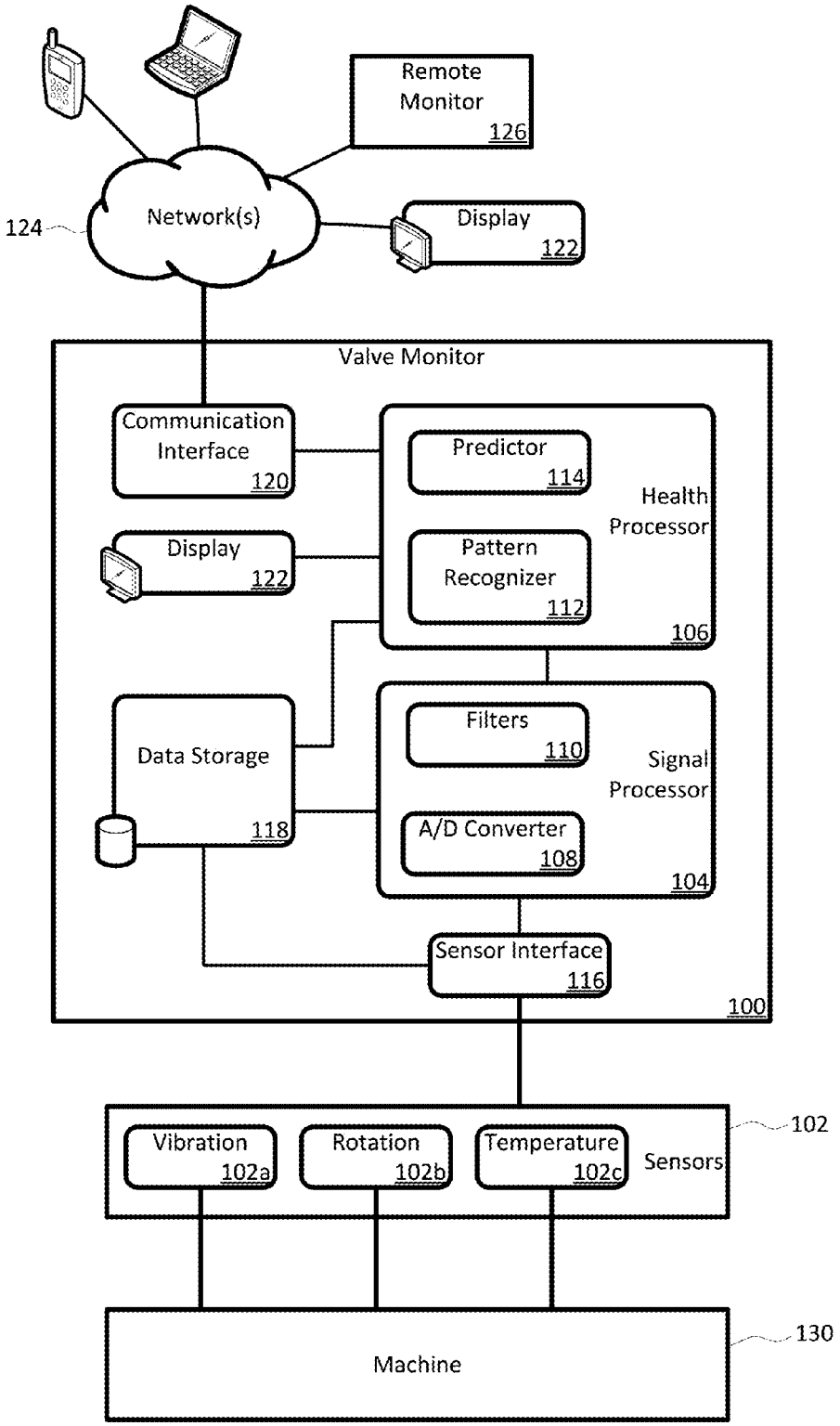
FIG. 1 is a simplified block diagram illustrating aspects of a valve monitor.

FIG. 1 illustrates aspects of the valve monitor used with a machine having multiple valves to be monitored. The core components of the valve monitor 100 include multiple sensors 102, a signal processing module 104, and a health processing module 106. The multiple sensors 102 of the valve monitor 100 are connected to a machine (equipment) 130 to be monitored. The sensors 102 include acceleration sensors 102*a* attached to each valve to be monitored and other components for measuring vibrations in the machine 130, a rotation sensor 102*b* attached to a crankshaft or other rotating structure, and, optionally, temperature sensors 102*c*. The signal processing module 104 processes the information obtained from the sensors 102 and computes waveform, spectrum, and analysis parameters from the acquired data. The health processing module 106 uses the information from the signal processor 104 to perform real-time analysis of the current health of the individual valves being monitored and evaluate normal operating parameters. The valve monitor 100 uses the information collected from the various sensors 102 to evaluate the health of individual valves of the machine 130.

The signal processor 104 includes various components, including, but not limited to, an analog-to-digital converter 108 and frequency band filters 110. The analog-to-digital converter 108 converts the analog signals generated by the sensors 102 into digital data for further processing by the signal processor 104.

The frequency band filters 110 remove low frequency components from the vibration signals measured by the acceleration sensors 102*a*. The frequency band filters 110 may be high pass filters or band pass filters that remove frequencies below a selected cutoff frequency. In various embodiments, the cutoff frequency ranges from about 5 kHz to about 20 kHz. In various embodiments, the signal processing module 104 processes the vibration signal from a valve on a single channel using a selected cutoff frequency. The cutoff frequency may be selected from any frequency within the range or limited to specific frequencies, such as about 5 kHz, about 10 kHz, and about 20 kHz.

The same signals or data may be processed by multiple channels to provide different data streams allowing the same signal to be analyzed in different ways by the valve monitor 100. In some embodiments, the signal processing module 104 may process the same vibration signal on multiple channels using frequency band filters 110 with different cutoff frequencies for simultaneous analysis of different frequency ranges. For example, multiple high pass filters with different frequency cutoffs (e.g., 5 kHz, 10 kHz, and 20 kHz) may be applied to a vibration signal providing multiple versions of the data to analyze.

In another example, vibration data from each sensor may processed on multiple channels. In various embodiments, vibration data in velocity units from a valve vibration sensor is acquired 10 times per second on one channel. Simultaneously, another channel processes the same vibration data to obtain peak value data in acceleration units once per second. The foregoing signal processing and analysis parameters should be considered exemplary of one suitable approach applied by the valve monitor 100. However, other sampling rates and analysis techniques may be applied to obtain suitable waveforms for assessing the health of individual valves. A channel may also pass the raw (i.e., unfiltered) vibration data on for analysis or storage.

The signal processing module 104 may operate on the analog signals received from the sensors 102 or the digital data once the analog signals have been converted by the analog-to-digital converter 108. Signal conditioning may be performed on the analog signals and/or the digital data. Examples of signal conditioning that may be utilized by the valve monitor include, without limitation, amplification, noise reduction, frequency band filtering, and downsampling the digital data (e.g., decimating the digital data). Aspects of the signal conditioning applied by the valve monitor 100 include applying one or more high pass or band pass filters to remove low frequency components from the acquired vibration signals.

The type and amount of processing applied depends on the type of signal. For example, analog vibration signals are initially processed using some analog signal processing, converted into a digital format, and then further processed through digital signal processing. Temperature signals, on the other hand, are converted into a digital format with little-to-no signal processing, either analog or digital.

Once a block of digital data is acquired at a constant sampling rate of desired length, typically a block size of 2n, where n is an integer, the valve monitor 100 further processes the digital data using one or more signal processing techniques and corresponding analysis techniques suitable for analyzing rotating equipment, such as, without limitation, spectral analysis. Spectral analysis produces a spectrum either in acceleration or velocity units from the digital time domain data using a Fast Fourier Transform (FFT) representing the time waveform. Spectral analysis allows separation of the band-limited signal into periodic components related to the turning speed of the machine.

Another suitable technique utilized by the valve monitor is a high frequency stress wave analysis, which attempts to determine the amplitude of each event, the approximate time required for the detected event to occur, and the rate at which events occur. Suitable implementations of stress wave analysis include, without limitation, the PeakVue™ analysis method (described in U.S. Pat. No. 5,895,857) developed by CSI, an Emerson Process Management company, and amplitude demodulation. While the valve monitor 100 is generally described herein using a PeakVue implementation, such description not intended to limit the valve monitor 100 to that particular high frequency stress wave technique. The PeakVue stress wave analysis technique typically includes analog-to-digital conversion at a high frequency sampling rate ($S_r$), such as 104 kHz, high-pass filtering, full wave rectification, and then selecting and holding a peak value within each sample interval to produce a selectively decimated waveform at a desired maximum frequency ($F_{max}$), where $S_r >> F_{max}$.

During PeakVue analysis, the valve monitor employs a high pass or band pass filter having a cutoff frequency that is greater than or equal to the Nyquist frequency and does not use a low pass filter at or slightly below the Nyquist frequency. The digital data block contains the absolute maximum values that the time waveform experiences over each time increment defined by the sampling rate. Hence, the analysis of this representative time waveform is the analysis of peak values. The PeakVue analysis includes an identification of periodicity that is best accomplished using spectral analysis. PeakVue analysis is optionally coupled with autocorrelation analysis, which has been found to be beneficial for the peak value time waveform.

Filtering the vibration data allows the valve monitor 100 to isolate impact data, which has been shown to be a good indicator of high frequency occurrences, such as flow turbulence and friction. More particularly, the frequency band filter 110 improves the signal-to-noise ratio for the signals of interest during high frequency stress wave analysis by removing or separating the overwhelming low frequency mechanical energy information from the high frequency stress wave information. This cleans up the waveforms by reducing or eliminating data that is not considered meaningful when assessing the valve health (i.e., noise) in order to more clearly depict the degradation level of the valve in the circular waveform. After removing the low frequency components, the valve events are typically more easily discernable.

Selective decimation of oversampled data via PeakVue utilizes a peak value detector which receives a vibration signal and detects a peak-hold or maximum peak amplitude value of the vibration signal during each sample time period, to produce a time series of peak vibration amplitudes comprising a peak value waveform. Other characteristics suitable for use in selective decimation of oversampled data suitable for distinguishing between normal and abnormal or properly functioning and improperly functioning valves include finding a relative or an absolute largest peak, a difference between maximum and minimum, a 50th percentile for sorted sample distribution, a relative or an absolute minimum, an operational condition of a sensor or circuit, a peak shape factor, a parametric versus causal characteristic, a statistical variance such as a standard deviation, a skewness factor, and kurtosis for analysis and interpretation of oversampled, high frequency data as disclosed in U.S. Patent Application Publication 2014/0324367, published Oct. 30, 2014, filed by the present Applicant on Apr. 15, 2014, which is incorporated by reference as if fully set forth herein.

The valve monitor 100 produces a circular waveform referenced to the revolution of the crankshaft from the analyzed digital data, such as the selectively decimated waveform, correlated with the revolution data from the tachometer. The circular waveform allows for immediate recognition of the valve action. With the circular waveform, the duration of the valve event is easily recognizable and trendable by the valve monitor. As valves wear, or springs weaken, the duration of the valve event will increase. Further, the circular waveform provides an immediate phase relationship with the compressor rotation to further assist with additional analysis. Aspects of the circular waveform include a zero degree, vertical point indicating an angular position corresponding to the tachometer pulse.

The health processing module 106 is primarily responsible for accurately monitoring process parameters and reliably protecting the machine 130 by comparing measured parameters against alarm set points and driving alarms and other triggers. More particularly, the health processing module 106 collects and computes waveform, spectrum, and analysis parameters from the acquired data and uses the measured and computed parameters to perform real-time analysis of the current health of the individual valves being monitored and evaluate normal operating parameters. In various embodiments, the health processing module 106 generates baseline parameters from a block of digital data collected by the signal processor 104 when monitoring begins.

Aspects of the health processor 106 include a pattern recognition module 110 and an optional prediction module 114. The pattern recognition module 110 detects valve failure or degradation based on variations in the acquired data that deviate from baseline parameters or are out of tolerances relative to the baseline parameters. The prediction module 114 diagnoses deteriorating valve conditions based on changes in the acquired data over time (i.e., trends).

In various embodiments, the valve monitor 110 includes various intermediate components such as, but not limited to, a sensor interface module 116, which facilitates connection of the sensors 106 to the valve monitor 100 and passes the incoming signals to the signal processing module 104 or other component of the valve monitor 100 or a connected system.

Optional components of the valve monitor 100 include a data storage module

118, a communication interface 120, and a display 122. While the valve monitor 100 generally includes volatile memory for short-term data storage used when processing data, the optional data storage module 118 provides non-volatile memory for extended storage of data collected by the sensors, analysis results, and other information. The extended data storage provided by the data storage module 115 allows the valve monitor 100 to maintain historical records for the machine 130, which is useful for purposes such as, but not limited to, analyzing trends and reporting.

The communication interface 120 allows the valve monitor to communicate alerts and other information to external devices and systems. In various embodiments, the communication interface 120 includes a network interface that allows the valve monitor 100 to connect to a network, such as, but not limited to, a local area network or the Internet and send alerts using email, instant messaging, and the like. Still further, the communication interface 120 optionally sends alerts to a master machinery monitoring system or other remotely-located monitoring station. In addition to or alternatively, the communication interface 120 includes a cellular network interface allowing voice messages (e.g., text-to-speech) or text messages to be sent to specified recipients. In some embodiments, the communication interface 120 is connected to audio output transducers (e.g., speakers) or video transducers (e.g., lamps) for generating audible or visual alert indicators in the event of valve failure or degradation.

The display 122 allows the valve monitor 100 to communicate information, such as, but not limited to, alerts, current operating parameters, and waveform plots to users. In some embodiments, the display is local to the valve monitor 100. In other embodiments, the display 100 is located at a remote monitoring station.

Figure 2:
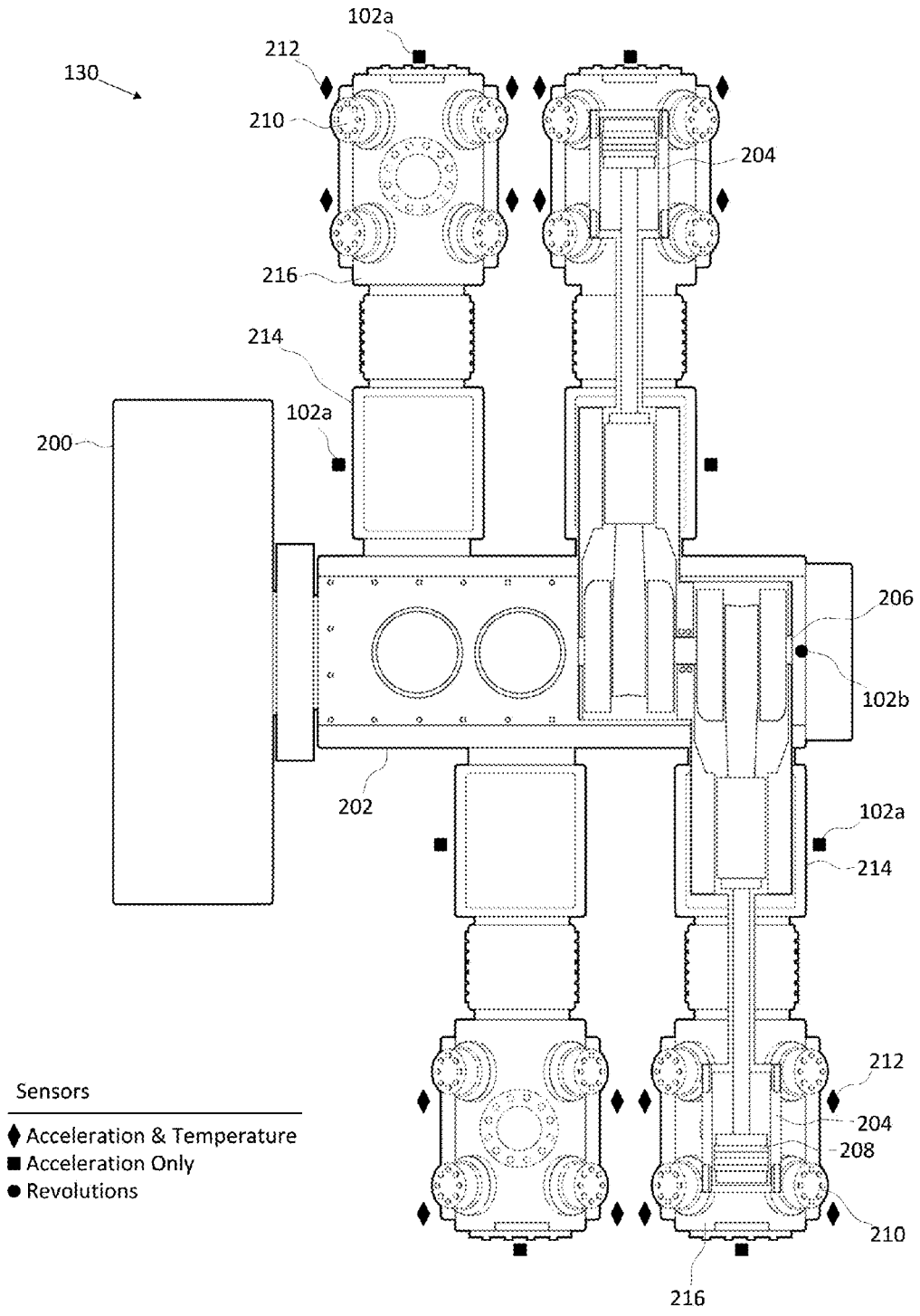
FIG. 2 illustrates aspects of the valve monitor used with a machine having multiple valves to be monitored.

FIG. 2 illustrates the aspects of the placement of the valve monitor sensors on a machine with multiple valves. In the illustrated embodiment, the representative machine 130 is a multi-cylinder reciprocating compressor 200. The machine 130 is described and depicted as a multi-cylinder reciprocating compressor 200 to give context to the explanation of the operation of the valve monitor 100. However, the valve monitor 100 is not limited to monitoring a multi-cylinder reciprocating compressor 200 and is suitable for use with other types of reciprocating machines 130.

The reciprocating compressor 200 includes a frame 202 having one or more cylinders 204. Here, the reciprocating compressor 200 is depicted using a cutaway drawing showing internal details of two cylinders 204. The frame 202 houses the rotating components including the crankshaft 206. The crankshaft 206 drives each piston 208 via the corresponding connecting linkages (e.g., connecting rods, crossheads, and piston rods). Each cylinder 204 includes a number of valves 210, which include both intake valves and exhaust valves.

Aspects of the compressor valve monitor include the use of different types of sensors 102 at different locations to monitor selected operating parameters of the reciprocating compressor 130. Preferably, the valve monitor 100 includes a valve sensor 212 for each intake or exhaust valve 216 that is being individually monitored and a rotation sensor 102*b* for the crankshaft 206.

More specifically, each valve 210 is outfitted with a sensor 212 capable of measuring at least vibration to collect vibration data for that specific valve. Suitable accelerometers preferably have frequency ranges covering at least the frequencies of interest (e.g., from about 5 kHz to at least 10 kHz and, preferably, up to at least about 20 kHz) and a sensitivity of at least 10 mv/g and, preferably, 100 mV/g. Optionally, each valve 210 is also outfitted with a sensor capable of collecting temperature data for that specific valve. In various embodiments, the valve sensors 212 are multi-purpose sensors capable of measuring correlated signals for vibration, temperature, and, optionally, other parameters (e.g., velocity), as shown. Alternatively, separate vibration sensors 102*a* and temperature sensors 102*c* are used, and the independent data streams are correlated based on acquisition times or other reference data points. In various embodiments, the valve sensors 212 are mounted on the valve covers bolts/studs via, e.g., a threaded or other mechanical connector or the valve cover via, e.g., a magnetic or adhesive connector. Other connector technologies may be used. And, with appropriate connector technologies, the valve sensors 212 may be attached at other locations on the valves 210.

The revolution sensor 102*b*, such as a tachometer, is installed on the crankshaft 206 to provide an accurate rotation speed and zero degree location when analyzing the vibration data. One example of a suitable tachometer is a tachometer with a resolution of the order of one pulse per revolution. However, other types of revolution sensors and other resolutions may be used without departing from the scope and spirit of the present invention.

Used in conjunction, the accelerometers 102*a* and the revolution sensor 102*b* allow the valve monitor 100 to measure the flow turbulence that occurs as each valve opens and closes and relate it to a consistent time in each revolution in order to identify valve events. By using the tachometer pulse as a reference point, the valve monitor 100 calculates the phase angle of valve events measured by the accelerometers 102*a*. Due to the fact that each region of valves acts at a given point in each rotation of the crankshaft 206, being able to determine the phase angle of the occurrence is essential so that other signatures present in a given valve reading can be related to other events happening on the reciprocating compressor 200.

The crossheads 214 are optionally instrumented with vertically-mounted vibration sensors 102*a* (e.g., single- or multi-axis acceleration sensors with one axis aligned vertically) to collect vibration data used for identifying problems arising from looseness associated with worn crosshead pins, crosshead shoe surface issues, packing issues, and the like. Similarly, the cylinder heads 216 are optionally instrumented with axially-mounted vibration sensors 102*a* (e.g., single- or multi-axis acceleration sensors with one axis aligned axially) to collect vibration data for identifying problems such as loose piston lock nuts, piston slap, worn wrist pins, and the like.

The health processing module 106 uses the baseline or normal operating parameters when assessing the health of the valve by comparing the current parameters against the baseline. Out of tolerance parameters may indicate a potentially failing (i.e., suspect) valve that warrants further analysis. Gross deviations in parameters may be used to identify a valve as failing or having failed without the need for further analysis. The baseline parameters and/or patterns may be established from data collected and processed from the valve for a selected amount of time (e.g., the first 10 minutes of operation), a selected number of revolutions (e.g., the first 1000 revolutions), or other criteria.

Trending various parameters over time allows the valve monitor 100 to track the degradation of the valves and issue alarms to plant personnel at various levels in order to allow sufficient time for scheduling repairs before unplanned catastrophic failures related to valve issues occur. More specifically, by continuously monitoring the vibration and/or temperatures on a valve over time, a rate of degradation can be established. Using parameters such as peak value alarm limits, the rate of change in the height and/or arc length/width from the baseline pattern, optionally in conjunction with changes in the valve temperature, the valve monitor is able to estimate when the valve is likely to fail. Other parameters may be evaluated when predicting valve failure. When the trend data is outside of tolerance, the health processor module 106 may initiate further analysis for a more accurate assessment of the valve health.

Trending may be performed using linear time domain waveforms or circular waveforms. For example, if the high frequency stress wave data or the high frequency vibration data crosses an alarm limit or is otherwise out of tolerance, the health processing module 106 may analyze the high frequency stress wave data using circular waveforms and pattern recognition to confirm a problem with the valve.

The circular waveforms utilized by the valve monitor 100 provide valuable information when evaluating valve health. The valve monitor 100 generates a circular waveform for each valve by graphing the high frequency stress wave analysis data for each revolution of the crankshaft. The circular waveforms graphically capture the repetition of the flow turbulence seen during each piston cycle and are well suited for visual inspection and pattern recognition to assess the health of the associated valve. By monitoring the high frequency stress wave analysis-based circular waveform for each valve rather than linear waveforms, the health processing module 106 is not solely reliant on an operating crank angle in order to determine which set of valves are suspect. Instead, patterns present in the circular waveforms, and deviations thereof, are discernable by the pattern recognition module 112 using image processing pattern recognition, envelope detection, and other techniques to distinguish between properly operating valves, suspect valves that may be degraded, and valves that have failed.

The circular waveforms may show digital data from multiple revolutions. The aggregated data may be plotted as single layer image combining data from each revolution or a multi-layer image where each layer plots data from a selected number of revolutions. While the valve events from each revolution will typically exhibit some variations, each valve event has a pattern that remains recognizable when aggregated over multiple revolutions. The pattern for each valve event can be characterized by one or more parameters, such as, but not limited to, the width or arc length, which corresponds to the event duration within the revolution, and the height, which corresponds to the vibrational force (e.g., acceleration) generated by the event. In other words, the pattern recognition module 112 determines that valve health is degrading when the parameters of the current data fall outside a selected tolerance from the parameters of the baseline pattern for the valve.

As previously mentioned, the peak amplitude falls and the event width increases as valve health degrades. For a parameter that increases as valve health degrades, such as width, the increase will be visible in any circular waveform regardless of how many revolutions have been plotted. Conversely, for a parameter that decreases as valve health degrades, such as height, the large amplitude peaks in the circular waveform collected when the valve was operating properly would mask the smaller amplitude peaks in the pattern. By displaying only a selected number of the most recent layers, the pattern changes to reflect the current state of the valve. In other words, as older data with larger valves is dropped from the circular waveform, the smaller values are no longer overshadowed. The rate at which older layers are dropped may be selected based on factors such as, but not limited to, how quickly valve health degradation is to be recognized or a minimum number of revolutions to be present in the circular waveform.

In some embodiments, the results of pattern matching are relied on for determining when a valve has failed. In other embodiments, pattern matching serves as a threshold monitoring activity used to identify valves suspected of experiencing problems and trigger more comprehensive analysis of the valve health.

Correlating vibration data and temperature data provides the valve monitor with additional predictive monitoring capabilities. As valves begin to leak, temperatures rise. Monitoring individual valve temperatures, as well as individual valve vibration signatures, the two different forms of data enhance the analysis capabilities of the valve monitor. With the enhanced analysis capabilities of the valve monitor, the problem valve is more easily identified versus monitoring cumulative data on a compressor head that only gives the region of the problem. Conventional machine monitoring systems only measure manifold gas pressures, not individual valve temperatures. This only allows conventional machine monitoring systems to determine which set of valves are questionable.

The valve monitor 100 measures and/or analyzes the selected parameters of the circular waveform to establish the baseline pattern. Embodiments of the valve monitor 100 employ analysis techniques such as, without limitation, minimum value detection, maximum value detection, detection of the valve event envelope, and other aggregation techniques, such as averaging, to calculate the baseline or normal operating parameters for the machine 130. Trend data may be collected and utilized when calculating the baseline. The collected data may be analyzed for trends to determine whether the data is reliable enough to establish a baseline. In other words, if the data appears to have an identifiable trend is classified as suspect, the data may not be useful for establishing a baseline.

Similarly, the health processing module 106 may initiate trend analysis using historical data and/or live data going forward on the suspect valve to watch for indications of a growing problem with the valve.

Aspects of the valve monitor 100 include suggesting a time when repair or replacement of the suspect valve should be performed prior to the predicted time of failure. If a problem with a valve is detected, embodiments of the valve monitor 100 use the trends to predict the time of failure. The suggested replacement time may be selected on based on various factors. For example, and without limitation, the suggested replacement time may be selected to preserve a selected minimum operating efficiency or to minimize risk to other machine components as the machine attempts to maintain normal operation. If the valve monitor is in communication with a management component that provides a machine readable operating schedule for the machine, the suggested replacement time may be based on an upcoming scheduled downtime before the predicted time of failure.

The valve monitor 100 includes transient monitoring capabilities that allow for replay of events in real time and further enhance the diagnostic capabilities of the valve monitor. Data feeds from the valve monitor 100 are optionally exported to other systems for integration with enterprise-level plant management or operation systems via the communication interface 120.

The operation of the valve monitor 100 described above is placed in context by looking at the following examples of the analysis results (e.g., the circular waveforms) generated from the data collected for an intake and an exhaust valve when they were properly operating and after they had failed.

Figure 3A:
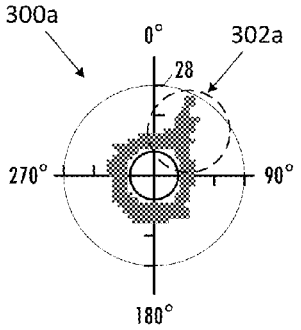
FIG. 3A is a circular waveform produced by the valve monitor for a properly operating intake valve using a 5 kHz high pass filter.
Figure 3B:
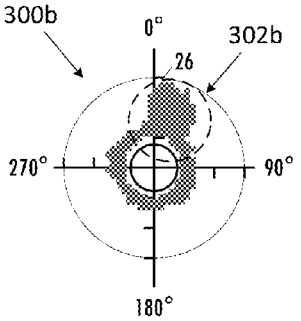
FIG. 3B is a circular waveform produced by the valve monitor for a properly operating intake valve using a 10 kHz high pass filter.
Figure 3C:
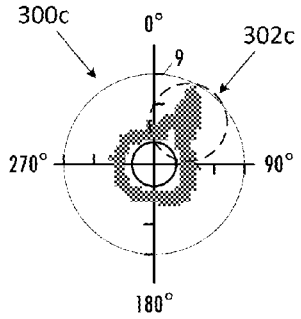
FIG. 3C is a circular waveform produced by the valve monitor for a properly operating intake valve using a 20 kHz high pass filter.

FIGS. 3A to 3C illustrate circular waveforms 300 generated using high frequency stress wave analysis with frequency cutoffs at 5 kHz, 10 kHz, and 20 kHz, respectively, to remove the low frequencies from data obtained from a properly operating intake valve. In each case, the waveforms show a valve event 302*a* with a clearly defined peak.

For the properly operating valve, each circular waveform 300 shows a crisp valve event 302*a* occurring on each revolution. The valve event 302*a* corresponds to the flow turbulence present when the valve opens and allows gas to flow through. The flow turbulence increases the magnitude of the high frequency stress wave signal when the valve opens and decreases when the valve closes. While the valve is closed for the majority of each revolution, the high frequency stress wave signal has a consistent magnitude. The properly operating valve opens and closes substantially at the same point during each revolution. The resulting temporary change in flow turbulence for a properly operating valve produces a valve event 302*a* with a magnitude that is significantly greater than the baseline magnitude and with well-defined front and rear edges from which to measure the width/arc length. This results in a recognizable pattern that can be detected by the health processing module to verify the valve is operating properly.

Figure 4A:
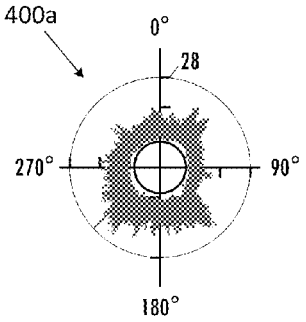
FIG. 4A is a circular waveform produced by the valve monitor for a leaking intake valve using a 5 kHz high pass filter.
Figure 4B:
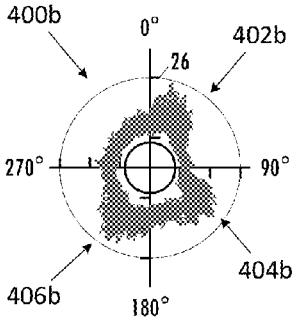
FIG. 4B is a circular waveform produced by the valve monitor for a leaking intake valve using a 10 kHz high pass filter.
Figure 4C:
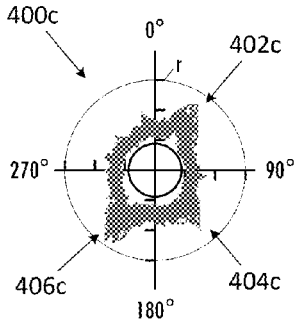
FIG. 4C is a circular waveform produced by the valve monitor for a leaking intake valve using a 20 kHz high pass filter.

FIGS. 4A to 4C illustrate the corresponding circular waveforms 400*a-c* obtained from a leaking intake valve. Because the vibration data corresponds to flow turbulence rather than a mechanical impact, the amplitude decreases when then the valve is not properly sealing. Accordingly, the circular waveforms for a leaking valve have greater base magnitude and/or a lower peak amplitude, possibly due to the less dramatic change of pressures across the leaking valve because it never fully seals. In FIG. 4A, the magnitude at the corresponding angular position in the circular waveform 400*a* is significantly lower than the magnitude of the valve event 302 in circular waveform 300*a*. Moreover, the overall baseline magnitude has generally increased due to the flow turbulence present throughout the majority of the revolution. A single, crisp valve event is not discernable in the circular waveform for the leaking intake valve. In other words, the resulting circular waveform 400*a* has no recognizable pattern. The lack of a recognizable valve event is an indicator that the valve is degraded or has failed.

Similar relationships exist for FIGS. 3B and 4B and FIGS. 3C and 4C. However, in the circular waveforms 400*b-c* of FIGS. 4B and 4C, the leaking valve exhibits multiple, but less distinct, valve events throughout the revolution rather than the lack of a clear valve event, as seen in FIG. 4A. In this case, there are three discernable valve events 402*a-c*, 404*a-c*, 406*a-c* per revolution rather than just the one valve event 302*a* that is present in the circular waveform 300*a* for the normally operating valve. The difference in the circular waveforms 400*b-c*, compared to the circular waveform 400*a*, illustrates signal-to-noise ratio improvements from using higher cutoff frequencies that remove more low frequency components associated with routine machine vibrations. With the noise removed, the circular waveforms 400*b-c* better illustrate an improperly sealing valve exhibiting an ongoing slow leak and periodically opening throughout the compression cycle when sufficient pressure builds. While different, these alternate patterns are equally recognizable as indicating a suspect valve by the image processing techniques applied by the pattern recognition module 112.

Figure 5A:
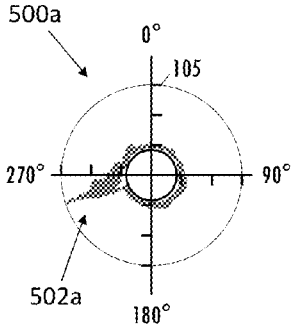
FIG. 5A is a circular waveform produced by the valve monitor for a properly operating exhaust valve using a 5 kHz high pass filter.
Figure 6A:
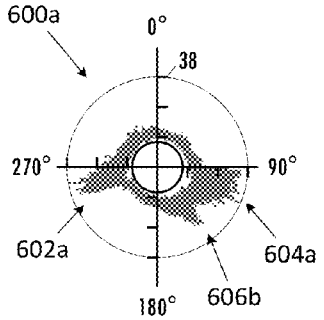
FIG. 6A is a circular waveform produced by the valve monitor for a leaking exhaust valve using a 5 kHz high pass filter.
Figure 5B:
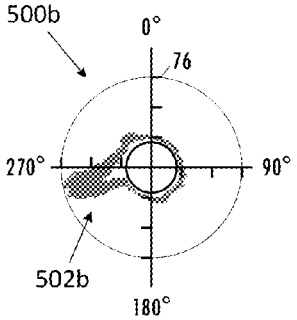
FIG. 5B is a circular waveform produced by the valve monitor for a properly operating exhaust valve using a 10 kHz high pass filter.
Figure 6B:
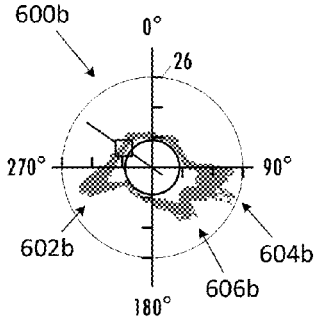
FIG. 6B is a circular waveform produced by the valve monitor for a leaking exhaust valve using a 10 kHz high pass filter.
Figure 5C:
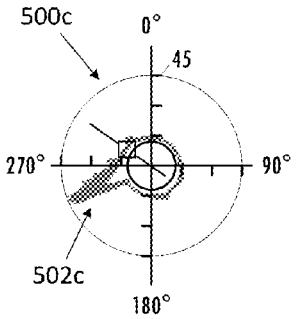
FIG. 5C is a circular waveform produced by the valve monitor for a properly operating exhaust valve using a 20 kHz high pass filter.
Figure 6C:
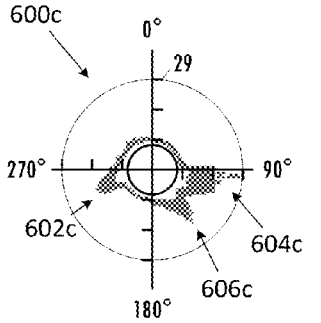
FIG. 6C is a circular waveform produced by the valve monitor for a leaking exhaust valve using a 20 kHz high pass filter.

FIGS. 5A to 5C illustrate circular waveforms 500 generated using high frequency stress wave analysis with frequency cutoffs at 5 kHz, 10 kHz, and 20 kHz, respectively, to remove the low frequencies from data obtained from a properly operating exhaust valve. FIGS. 6A to 6C illustrate the corresponding circular waveforms 600 obtained from a leaking exhaust valve. As seen in FIGS. 5A to 6C, the exhaust valves produce waveforms with the same types of patterns discussed above for intake valves. However, the valve events 502*a*, 502*b*, 502*c* tend to be more defined and the magnitudes tend to be larger for the exhaust valves, presumably due to the higher pressure differential.

In circular waveform 600*a*, the leaking exhaust valve appears to have one or two additional valve events for a total of three degraded valve events 602*a*, 604*a*, 606*a*. In circular waveform 600*b*, the distinction between the second and third valve events 604*b*, 606*b* is slightly clearer due to the improved signal-to-noise ratio. The removal of additional low frequency components in circular waveform 600*c* improves clarity yet again, and shows even greater changes in magnitude when compared to the valve event 502*c* corresponding to a properly operating valve, which is beneficial when evaluating of the health of the valve.

Figure 7:
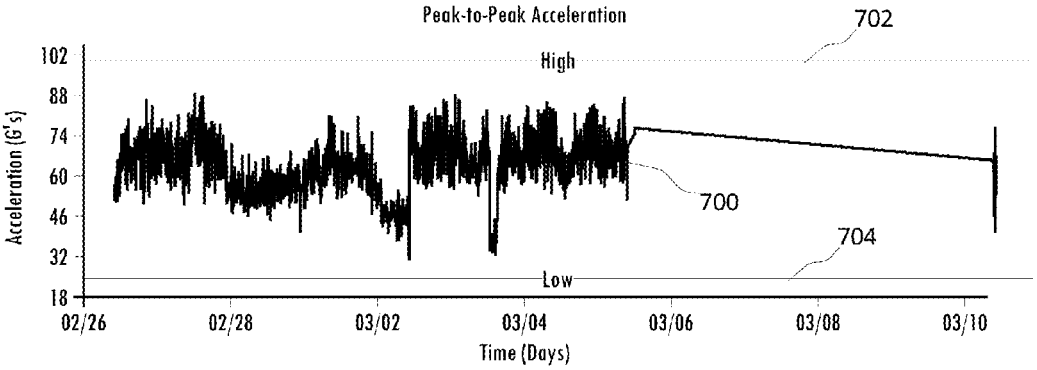
FIG. 7 is a linear time plot of peak-to-peak trend data collected from the machine for a properly operating valve, showing the high and low alarm limits.
Figure 8:
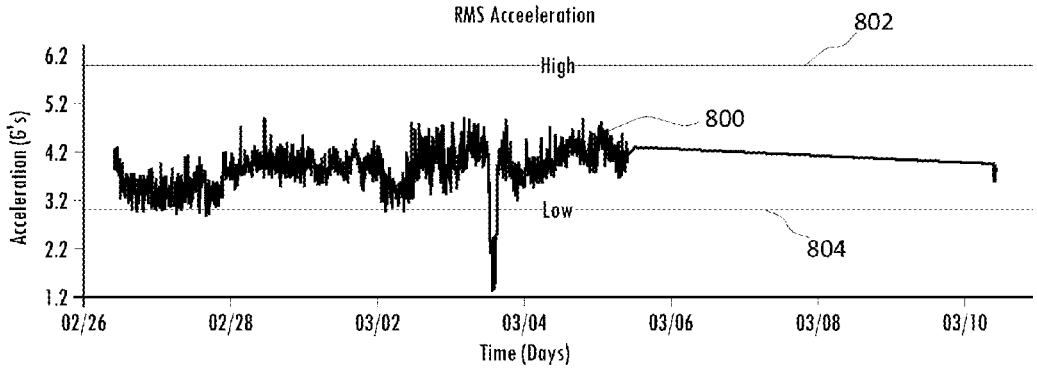
FIG. 8 is a linear time plot of high frequency vibration trend data collected from the machine for a properly operating valve, showing the high and low alarm limits.

FIGS. 7 and 8 are graphs of the high frequency stress wave analysis data and the high frequency vibration data, respectively, from a healthy valve for use in trend analysis. Trending of the peak-to-peak high frequency stress wave analysis data 700 and/or the peak-to-peak high frequency vibration data 800, which provides an overall RMS value, allows monitoring of the values over time to determine when further analysis is required. The valve monitor 100 uses the trends for predicting when the valve is likely to fail and, optionally, for other tasks such as learning the normal operating values for each valve (i.e., baseline each valve). In various embodiments, the valve monitor sets high amplitude alarm levels 702, 802 and/or low amplitude alarm levels 704, 804 based on the normal operating value trends. If the operating values for a valve goes above or falls below the appropriate alarm limit, the valve monitor applies further analysis to the suspect valve.

To provide tolerance, the alarm levels may be offset from the peak values. Alternatively, or in addition to alarm level offsets, embodiments of the valve monitor may include logic to ignore an anomalous peak by requiring extended (i.e., substantially continuous) alarm limit crossings or multiple alarm limit crossings within a selected amount of time. In various embodiments, the valve monitor utilizes both high amplitude and low amplitude alarm levels because the high frequency amplitudes have a tendency to decrease as the valve health declines.

Figure 9A:
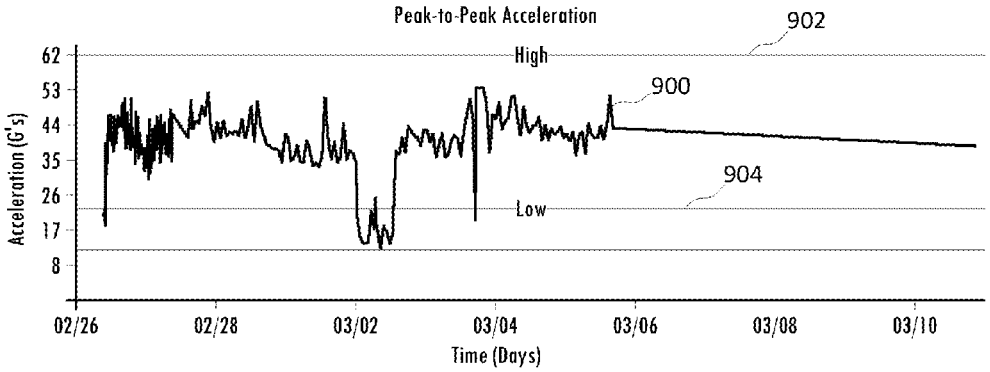
FIG. 9A is a linear time plot of peak-to-peak trend data collected from the machine for a healthy valve.
Figure 9B:
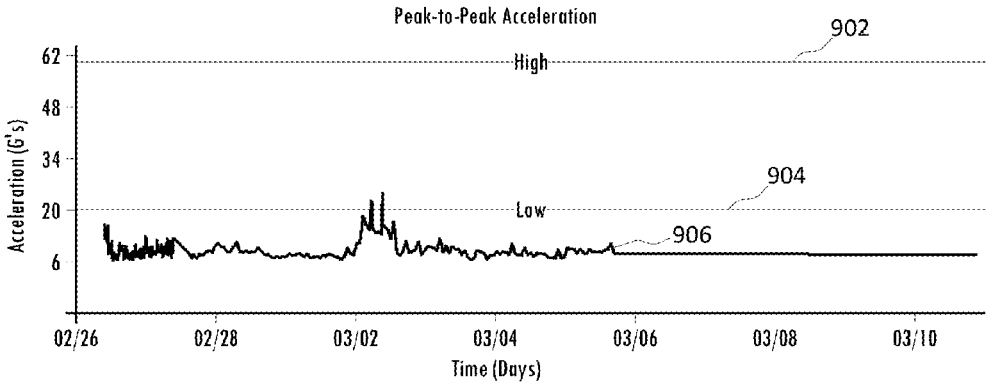
FIG. 9B is a linear time plot of peak-to-peak trend data collected from the machine for a suspect valve.

FIGS. 9A and 9B provide a comparative trend of the high frequency stress wave analysis data for a properly performing valve 900 and a suspect valve 906, respectively. In FIG. 9A, the overall signal is generally between the high and low alarm limits 902, 904. In FIG. 9B, the peak-to-peak amplitude of the signal has dropped significantly and the overall signal is below the lower alarm limit 904, indicating that the valve may be experiencing a problem and triggering the valve monitor 100 to conduct further analysis of the suspect valve.

Figure 10A:
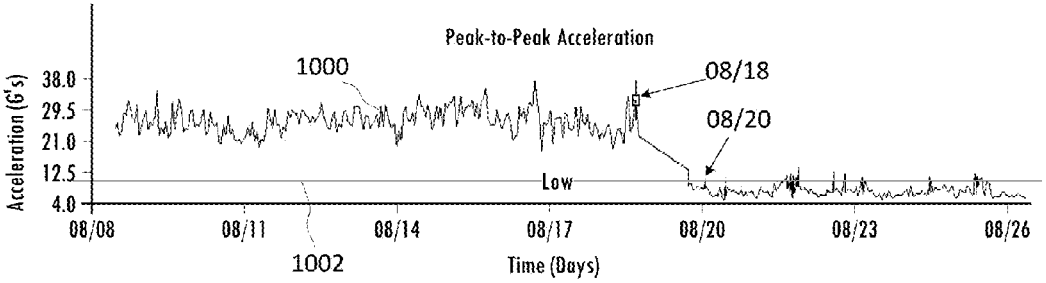
FIG. 10A is a linear time plot of high frequency stress wave analysis data showing a decline in valve health.

FIGS. 10A to 10E show how the trend values and patterns changes as the valve health declines. Looking first at the trend values, FIG. 10A illustrates a linear time domain waveform 1000 with peak-to-peak values above a low alarm limit 1002 (i.e., within normal operating parameters) until August 18th. By August 20th, the overall magnitude of the signal has dropped below the low alarm limit 1002 and the peak-to-peak amplitude has significantly decreased.

Figure 10B:
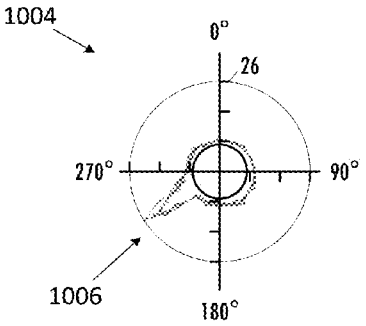
FIG. 10B is a circular waveform produced by the valve monitor while the valve is still properly operating, but beginning to fail.
Figure 10C:
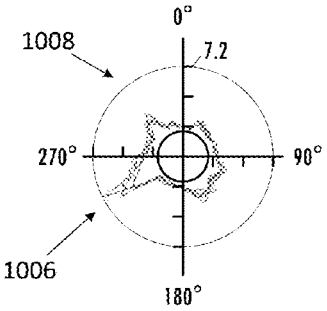
FIG. 10C is a circular waveform produced by the valve monitor after failure when the valve is leaking.
Figure 10D:
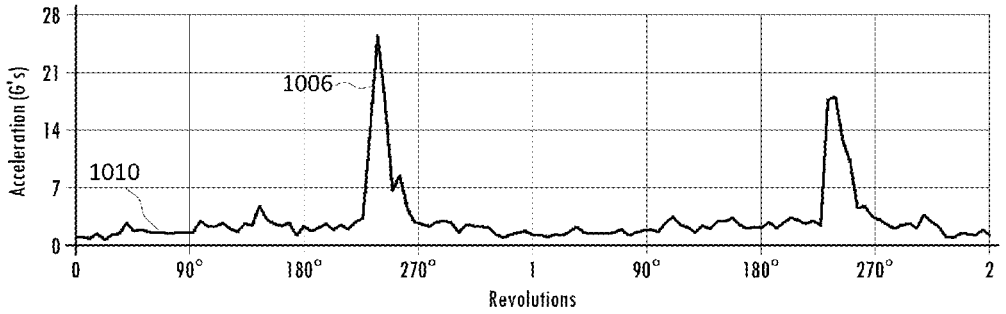
FIG. 10D is a strip format plot, correlated to angular rotation, of vibration data produced by the valve monitor while the valve is still properly operating, but beginning to fail.
Figure 10E:
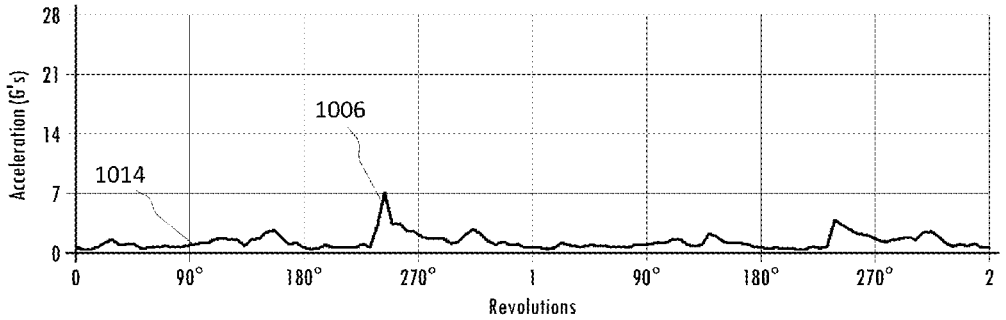
FIG. 10E is a strip format plot, correlated to angular rotation, of vibration data produced by the valve monitor after failure when the valve is leaking.

FIG. 10B shows a circular waveform 1004, which includes data obtained over five revolutions, produced on August 18th when the valve was functioning properly as indicated by a crisp valve event 1006. The valve event 1006 is directly relatable to the phase angle of the compressor crankshaft and the timing of the valve. FIG. 10C shows a circular waveform for five revolutions generated on August 20th. The circular waveform 1008 after the valve has failed is less defined and shows a large amount of energy present during the entire revolution.

The same patterns are present when the high frequency vibration data signal is plotted in a linear format. The linear waveform 1010 of FIG. 10D from August 18th, when the valve was functioning properly, depicts a valve event 1012 with energy that has a large amplitude and clearly discernable peak based on the operational timing of the particular valve, in this case, around 225°. In contrast, once the valve has failed, the peak amplitude of the valve event 1006 from the linear waveform 1014 in FIG. 10E generated on August 20th decreases significantly, and the peak becomes less discernable.

Figure 11A:
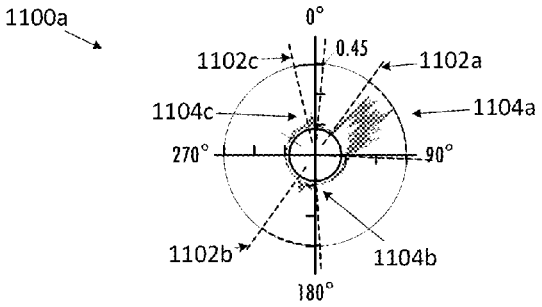
FIG. 11A is a circular waveform illustrating the use of waveform parameter bands to highlight specific features of the waveform.
Figure 11B:
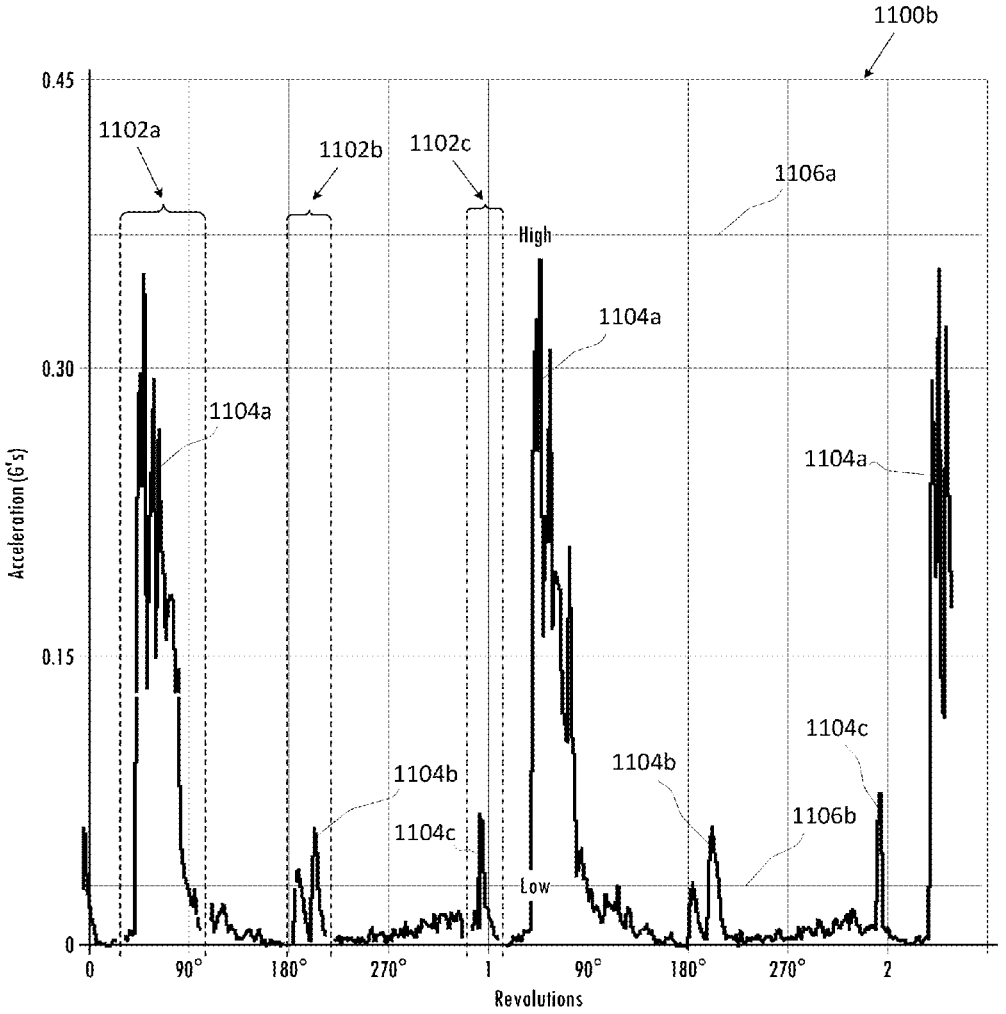
FIG. 11B is a linear waveform illustrating the use of waveform parameter bands to highlight specific features of the waveform.

FIGS. 11A and 11B illustrate the use of waveform parameter bands to highlight specific features of a waveform. Both the circular waveform 1100*a* and the corresponding linear waveform 1100*b* are depicted with parameter bands 1102*a-c* assigned for selected angular ranges of crankshaft rotation corresponding to specific waveform features, such as valve events 1104*a-c*. The waveform parameter bands 1102*a-c* define regions of interest in the waveform 1100*a-b* that are preferably captured and trended. The waveform parameter bands 1102*a-c* may be manually or automatically assigned. Preferably, the valve monitor automatically assigns the waveform parameter bands 1102*a-c* around regions of the waveforms 1100*a-b* where the peak-to-peak amplitude within a particular angular range exceeds a threshold. For example, the threshold may be set as a multiple of the average minimum peak-to-peak amplitude over a selected angular range. Other parameters and criteria for determining a peak-to-peak amplitude threshold or selecting a region of interest in a waveform may be used without departing from the scope and spirit of the present invention.

By capturing and trending the limited regions of interest, data processing and storage requirements are reduced compared to capturing and trending the entire waveform. Alarm levels 1106*a-b* may be attached to the waveform parameter bands to further enhance analysis and notification. Of course, the valve monitor 100 may still capture and trend the entire waveform if desired. Aspects include the ability to configure the valve monitor 100 to capture and trend the entire waveform when certain conditions are met. For example, the valve monitor 100 may normally capture and trend only the waveform parameter bands 1102*a-c* for properly operating valves. When an alarm is triggered, the valve monitor 100 may begin capturing and trending the entire waveform for the suspect valve. Further, various embodiments of valve monitor 100 only raise alarms when an alarm level violation occurs within one of the waveform parameter bands 1102*a-c*. By limiting the regions of the waveform where alarm levels are enforced, more precise alarm levels may be defined. This allows, for example, low alarm levels to be set above the maximum amplitude of the waveform when a properly performing valve is closed (i.e., outside of valve events). Moreover, alarm levels specific to a particular waveform parameter band 1102*a-c* may be set. For example, the low alarm level for the major valve event 1104*a* may be set at a threshold above the maximum amplitude of the minor valve events 1104*b-c*.

By monitoring each valve independently, particularly with PeakVue or another high frequency stress wave analysis technology, the valve monitor 100 is able to precisely determine which valve is having issues and request replacement of that particular valve rather than requesting replacement of all valves in a particular region. Continuous monitoring and trending of vibration data allows predictive analysis to identify valves exhibiting signs of impending failure and rapid reporting when a valve fails. By identifying failing valves prior to actual failure, the valve monitor 100 allows valve replacement as part of a scheduled maintenance program, which reduces unplanned equipment downtime. By rapidly reporting a valve failure, the valve monitor 100 allows plant operators to repair or replace leaking valves promptly, rather than allowing the equipment to operate at reduced efficiency due to the leaking valve. This also saves the equipment from the unnecessary and accelerated wear and tear that occurs when a valve fails and the equipment attempts to compensate. For example, the reciprocating compressor may work harder to maintain the expected pressure, placing stress on other components. Ultimately, detecting and/or predicting individual valve failure or degradation generate savings for the plant operators by decreasing repair or replacement costs, as well as repair downtime.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A valve monitor for use with a rotating machine having a plurality of valves and a rotating element, the valve monitor comprising:

a plurality of valve sensors detecting at least vibration, each valve sensor uniquely associated with one of the valves, each valve sensor measuring vibrations at the associated valve and generating a vibration signal;

a tachometer associated with the rotating element of the rotating machine to measure rotation of the rotating element; and a signal processing module in communication with each valve sensor and the tachometer, the signal processing module including a frequency filter operable to remove low frequency components below a selected frequency from the vibration signal to produce a filtered vibration signal, the signal processing module operable to:

correlate the vibration signal with an angular position corresponding to the rotation of the rotating element;

apply a stress wave analysis to digital data representing the filtered vibration signal from a selected valve to produce analyzed data corresponding to flow turbulence at the selected valve; and generate a circular waveform representing the flow turbulence at the selected valve based on the analyzed data.

2. The valve monitor of claim 1 wherein the signal processing module is further operable to selectively decimate the vibration data based on a selected characteristic, wherein the selected characteristic is a maximum amplitude, a minimum amplitude, a differential amplitude, a median amplitude, a statistical variance, a peak shape factor, a parametric versus casual characteristic, a skewness factor, or a kurtosis factor.

3. The valve monitor of claim 1 further comprising a health processing module in communication with the signal processing module, the health processing module operable to:

assess valve health of the selected valve using the corresponding circular waveforms to compare the selected current operating parameters of the selected valve to corresponding baseline parameters of the selected valve; and generate an alarm indicating that the selected valve has experienced degradation when the selected current operating parameters are out of tolerance relative to the corresponding baseline parameters.

4. The valve monitor of claim 1 wherein the signal processing module is further operable to:

identify regions of interest within the circular waveform, the regions of interest including angular ranges in which selected maximum peak amplitudes occur;

assign waveform parameter bands corresponding to the angular range covering the regions of interest.

5. The valve monitor of claim 4 further comprising a data storage unit for archival of data and wherein the signal processing module is further operable to:

store at least one of the vibration signal, the digital data, and the analyzed data corresponding to the waveform parameter bands in the data storage unit; and monitor trends in the analyzed data corresponding to the waveform parameter bands.

6. The valve monitor of claim 4 wherein the signal processing module is further operable to:

assign alarm levels indicating when the selected current operating parameters are out of tolerance relative to the corresponding baseline parameters; and monitor alarm levels only within the waveform parameter bands.

7. The valve monitor of claim 1 wherein the health processing module further comprises a pattern recognition module operable to detect patterns in the circular waveform corresponding to current operating parameters of the selected valve.

8. The valve monitor of claim 1 wherein the health processing module further comprises a prediction module operable to detect patterns in the circular waveforms corresponding to current operating parameters of the selected valve.

9. The valve monitor of claim 1 wherein one of the signal processing module and the health processing module is operable to:

detect when the filtered vibration signal for the selected valve is outside of alarm levels; and initiate further analysis of the selected valve to assess valve health.

10. The valve monitor of claim 1 wherein each valve sensor further includes a temperature sensor measuring a temperature at the associated valve, the health processing module operable to:

monitor the selected valve for increases in the temperature corresponding to valve degradation; and assess valve health of the selected valve based on both temperature and a comparison of the selected current operating parameters of the selected valve to corresponding baseline parameters of the selected valve using the corresponding circular waveforms.

11. The valve monitor of claim 1 wherein the selected frequency is at least about 5 kHz.

12. A method of directly monitoring individual valves of a compressor having multiple cylinders, a piston associated with each cylinder, and a crankshaft driving the pistons, each cylinder comprising a cylinder head having a plurality of valves, the method comprising the acts of:

uniquely associating, with each valve, a valve sensor measuring at least vibrations;

measuring an analog vibration signal from each valve sensor;

converting each analog vibration signal into digital vibration data;

for each valve:

removing low frequency vibration components from the digital vibration data;

analyzing the digital vibration data using a high frequency stress wave analysis technique to generate analyzed digital vibration data;

generating a circular waveform based on the analyzed digital vibration data corresponding to the valve; and determining a health for each valve based on one or more peaks appearing in the circular waveform.

13. The method of claim 12 further comprising the acts of:

associating a tachometer with the crankshaft;

measuring a pulse from the tachometer corresponding to a revolution of the crankshaft; and plotting the circular waveform relative to the pulse, wherein the pulse represents a zero degree angular position.

14. The method of claim 12 wherein the act of determining a health for each valve based on one or more peaks appearing in the circular waveform further comprises the acts of:

determining that the valve is operating properly when the corresponding circular waveform contains a single distinct peak; and determining that the valve is malfunctioning when the corresponding circular waveform contains multiple indistinct peaks with lower peak amplitudes.

15. The method of claim 14 wherein the act of determining a health for each valve based on one or more peaks appearing in circular waveform further comprises the acts of:

collecting a temperature signal from each valve;

correlating the analyzed digital vibration data with the temperature signal; and determining that the valve is malfunctioning when the corresponding circular waveform contains multiple indistinct peaks and the temperature signal shows an increasing valve temperature.

16. The method of claim 12 further comprising the acts of:

accumulating digital vibration data over time for each valve;

identifying one of the valves as a degraded valve based on changes in accumulated digital vibration data associated with that valve over time;

assigning a degradation level to the degraded valve based on the changes in the accumulated digital vibration data associated with that valve; and generating a notification pertaining to the degraded valve.

17. The method of claim 12 further comprising the acts of:

calculating values of a representative characteristic of the digital vibration data within multiple sampling intervals corresponding to a target sample rate; and generating downsampled digital vibration data from the values of the representative characteristic for each sampling interval.

18. The method of claim 17 wherein the act of calculating a value of the representative characteristic of the digital vibration data within the sampling interval corresponding to the target sample rate further comprises the act of calculating at least one of a maximum amplitude, a minimum amplitude, a differential amplitude, a median amplitude, a statistical variance, a peak shape factor, a parametric versus casual characteristic, a skewness factor, or a kurtosis factor of the digital vibration data within the sampling interval.

19. The method of claim 12 further comprising the acts of:

storing at least one of the digital vibration data and the analyzed digital vibration data as historical data; and analyzing the historical data for trends; and predicting failure of the valves based on a rate of change of a selected parameter in the analyzed digital vibration data.

20. A valve monitor for use with a reciprocating compressor having multiple valves operatively driven by a crankshaft, the valve monitor comprising:

a valve sensor uniquely associated with one of the valves for measuring vibrations at the associated valve and producing a vibration signal based thereon;

a tachometer associated with the crankshaft to measure rotation of the crankshaft;

a signal processing module in communication with each valve sensor and the tachometer, the signal processing module including a frequency filter operable to remove low frequency components below a frequency of at least about 5 kHz from the vibration signal to produce a high frequency vibration signal, the signal processing module operable to:

correlate the vibration signal with an angular position corresponding to the rotation of the crankshaft;

monitor trends in the vibration signal in relation to alarm limits;

perform stress wave analysis using the high frequency vibration signal from the valve to produce analyzed data corresponding to the flow turbulence at the valve when the high frequency vibration signal is outside alarm limits; and generate a circular waveform representing the flow turbulence at the selected valve based on the analyzed data; and a health processing module in communication with the signal processing module, the health processing module operable to:

assess valve health of the valve based on a comparison of current operating parameters of the valve to corresponding baseline parameters of the valve using the circular waveform;

identify the valve as failing when the current operating parameters are out of tolerance relative to the corresponding baseline parameters;

predict a failure time for the valve based on a rate of change of the current operating parameters relative to previous operating parameters; and generate an alarm indicating the predicted failure time in advance of actual failure of the valve.

* * * * *